US005913264A

United States Patent [19]

Eppinger

[11] Patent Number: 5,913,264

[45] Date of Patent: Jun. 22, 1999

[54] SCREEN PRINTING MACHINE WITH ROTOR AND STATOR GUIDING MEANS

[76] Inventor: Otto Richard Eppinger, 20-22 Braeside Drive, Braeside, Victoria 3195, Australia

[21] Appl. No.: 08/578,529

[22] PCT Filed: Jul. 5, 1994

[86] PCT No.: PCT/AU94/00373

§ 371 Date: Jan. 5, 1996

§ 102(e) Date: Jan. 5, 1996

[87] PCT Pub. No.: WO95/01875

PCT Pub. Date: Jan. 19, 1995

[30] Foreign Application Priority Data

Jul. 6, 1993 [AU] Australia ..... PL9775

[51] Int. Cl.[6] ..... B41F 15/10

[52] U.S. Cl. ..... 101/115; 101/126; 101/DIG. 36

[58] Field of Search ..... 101/115, 126, 101/127.1, 129, DIG. 36

[56] References Cited

U.S. PATENT DOCUMENTS

| | | | |
|---|---|---|---|
| 2,485,289 | 10/1949 | Jane | 101/115 |
| 4,084,504 | 4/1978 | Fuchs | 101/115 |
| 4,583,458 | 4/1986 | Beachum | 101/115 |
| 4,753,162 | 6/1988 | Bubley | 101/115 |
| 4,909,142 | 3/1990 | Bubley | 101/115 |
| 4,920,878 | 5/1990 | Harpold et al. | 101/115 |
| 4,974,507 | 12/1990 | Eppinger | 101/115 |
| 4,974,508 | 12/1990 | Andersen et al. | 101/115 |
| 5,020,430 | 6/1991 | Harpold et al. | 101/115 |
| 5,090,311 | 2/1992 | Brasa | 101/115 |
| 5,154,119 | 10/1992 | Fuqua et al. | 101/115 |
| 5,161,460 | 11/1992 | Andersen et al. | 101/115 |
| 5,239,923 | 8/1993 | Belcher et al. | 101/115 |

FOREIGN PATENT DOCUMENTS

| | | | |
|---|---|---|---|
| 79 12600 | 12/1980 | France . | |
| 2456619 | 1/1981 | France | 101/126 |
| 36449 | 2/1989 | Japan | 101/115 |

*Primary Examiner*—Stephen R. Funk
*Attorney, Agent, or Firm*—D. Peter Hochberg

[57] ABSTRACT

A screen printing machine having a rotor, a stator, a device for moving the rotor and stator into juxtaposition, and an annular track and track followers for guiding the rotor in vertical and radial directions.

11 Claims, 10 Drawing Sheets

SCREEN PRINTING MACHINE WITH ROTOR AND STATOR GUIDING MEANS

This application is a 371 of PCT/AU94/00373, filed on Jul. 5, 1994.

BACKGROUND OF THE INVENTION

1. Field of the Ivention

This invention relates to stabilized screen printing.

2. Description of the Prior Art

Many types of screen printing apparatus are known but many suffer difficulties with accuracy of alignment and indexing and in structural complexity and cost. Applicant has been active in the design of screen printing apparatus and reference is made to U.S. Pat. Nos. 5,189,950; 5,031,527; 4,974,507; 4,962,702; and 4,934,263 all of which disclose effective and useful apparatus. Reference is now made to drawings illustrating certain prior art apparatus.

Reference is made to FIG. 1A which shows a base 1, a central column 2 secured to the base, a rotor 3 which rotates on the column 2 between a number of radially indexed positions and which carries part 4 of screen printing apparatus. The rotor 3 has a bearing (not shown) which is mounted to rotate on the column 2. A stator 6 is mounted for vertical movement on the column 2 and has a bearing (not shown) which can move on the column 2 to guide the stator in vertical position from the full line position to the dash line position as shown. The stator 6 carries part 7 of screen printing apparatus. Cost and accuracy problems associated with the above machine are that the column 2 needs to be massive and must be machined over a substantial length to provide accurate bearing surfaces for the bearing associated with the rotor 3 and the bearing associated with the stator 6.

Reference is made to FIG. 1B which shows a base 21, a central column 22 secured to the base, a rotor 23 which rotates on the column 22 between a number of radially indexed positions and which carries part 24 of screen printing apparatus. The rotor 23 has a bearing (not shown) which is mounted to rotate on the column 22. A stator 26 is mounted on the column 22 and carries part 27 of screen printing apparatus which is pivotably mounted to the stator 26 to move between the full line position to the dash line position as shown. Cost and accuracy problems associated with the above machine are that the column 22 needs to be substantial and must be machined to provide accurate bearing surfaces for the bearing associated with the rotor 23.

Reference is now made to FIG. 1C which is similar to the apparatus shown in FIG. 1B and like numerals denote like parts. In this case, however, part 37 of screen printing apparatus is carried by towers 38 to move between the full line position and dash line position as shown. The machine shown in FIG. 1C has similar cost and accuracy problems to the machine shown in FIG. 1B.

Reference is now made to FIG. 1D which shows a base 41, a central column 42 secured to the base, a rotor 43 which rotates on the column 42 between a number of radially indexed positions and which carries a part 44 of screen printing apparatus. The rotor 43 has a bearing comprising upper and lower parts 45 and 49 which is mounted to rotate on the column 42. A stator 46 is mounted to the column 42 and carries part 47 of the screen printing apparatus. In use the rotor 43 can be raised from the full line position to the dash line position as shown with the bearing parts 45 and 49 guiding. Cost and accuracy problems are similar to those in respect of the machine shown in FIG. 1A.

Reference is now made to FIG. 1E which shows a machine similar to that shown in FIG. 1D and like numerals denote like parts. However, in this instance lifting cylinders 51 are located a substantial distance from the column 42. Cost and accuracy problems are similar to those discussed in respect to the machine shown in FIG. 1A. Other difficulties associated with some of the above machines are that lifting loads are too close to the column and there is a lack of registration accuracy.

SUMMARY OF THE INVENTION

The present invention provides, in a first aspect, a screen printing machine comprising a rotor and a stator wherein one of or a part of one of the rotor and stator is movable vertically to bring the rotor and stator into juxtaposition and wherein there is provided an annular track and track follower means for guiding the rotor to turn in the plane of or a plane parallel to that of the annular track.

The present invention also provides, in a second aspect, a screen printing machine comprising a rotor and a stator wherein one of or part of one of the rotor and stator is movable vertically to bring the rotor and stator into juxtaposition and wherein the rotor and stator are provided with radially disposed abutments adapted to come into abutting relation on such vertical movement whereby to provide support for the upper one of the rotor and stator.

The present invention also provides, in a third aspect, a method of screen printing utilizing a screen printing machine a rotor and a stator wherein one of or part of one of the rotor and stator is movable vertically to bring the rotor and stator into juxtaposition and wherein the method comprises rotating and guiding the rotor with a measure of accuracy and during the vertical movement guiding the rotor and stator or said part with a greater measure of accuracy as they approach juxtaposition.

The present invention also provides, in a fourth aspect, a screen printing machine comprising a rotor and a stator wherein one of or part of one of the rotor and the stator is movable vertically to bring the rotor and the stator into juxtaposition and wherein there is a support means for supporting and guiding the rotor in rotation and further comprising lifting means for vertically moving said one of or part of one of the rotor and stator located radially outward of said support means.

Generally speaking the invention particularly relates to screen printing machines wherein, the rotor or stator are provided with a plurality of work stations and the other of the rotor or stator is provided with printing stations which printing and work stations come into registry when the rotor is indexed in its rotary motion and the rotor and stator are brought into juxtaposition.

The following concerns the track and related aspects. Preferably there is a central structure supporting the stator and the annular track is secured from the central structure. Preferably that central structure passes through the rotor. The central structure may be made massive but not necessarily at the price of using heavy steel sections and extensive machining. The central structure may be supported by a base and which base may support the annular track. The annular track preferably guides the rotor on a circle having a radius not less than 25% of the radius of the rotor. The annular track may be comprised of a number of sectors of arc joined together or to a support for the annular track.

Preferably the annular track comprises a generally horizontal portion for guiding the rotor in moving in a circular path and a generally vertical portion for guiding the rotor radially. Alternatively the annular track may be provided with a profiled surface around its perimeter or the internal circular opening defining the track annulus and the profiled surface cooperates with correspondingly profiled followers to guide the rotor to turn in the plane of, or a plane parallel to that of the annular track. Preferably the profiled surface has a generally inverted V-shape and the followers have a complementary V profile. It is generally preferred that the rotor is above the annular track.

In one instance it is the rotor which is movable vertically and the rotor may be moved vertically away from the annular track or the rotor and the annular track may together be moved vertically. The annular track may be ridden on by said track follower means or the annular track may ride on the track follower means.

In another instance the stator is movable vertically. In yet another instance one of the rotor or stator has arms which can move vertically either directly or by pivoting. Preferably the annular track is located at a radius of at least 300 mm from the center of rotation of the rotor. There may be several such annular tracks and these might be spaced radially or vertically from one another.

The following concerns the abutments and related aspects. The abutments can serve several useful purposes including supporting, stabilizing, strengthening and positional adjustment. In this last respect, the abutments preferably interengage so as to make of the rotor and stator a substantial structure having substantially more strength in respect of rigidity than the rotor or stator individually. Further, the abutments may be used to position the rotor and stator vertically, laterally, radially or angularly with respect to one another. One or more of the abutments may be movable in position to provide adjustment. Of particular interest is in ensuring accuracy of relatively rotated position and to compensate for difference in thickness of materials to be printed. The adjustment may be vertical, lateral, radial or angular. The abutments preferably comprise a projection on one of the rotor and stator and a complementary recess in the other of the rotor and stator and/or complementary projections on both of the rotor and stator. There may be a plurality of such projections and recesses.

In a further preferred aspect the rotor and stator may be provided with first and second abutments, the first of the abutments serving to guide the rotor and stator radially and the second of the abutments guiding them vertically.

Hitherto it has been common in screen printing machines where a bearing moves on a cylindrical column to machine the column and bearing with substantial accuracy and to index the rotor with substantial accuracy. However, by the combination of the annular track and the abutments, we now appreciate that the track and the track followers can be relatively inaccurate provided that sufficient accuracy is provided by the abutments.

Thus, in a particularly preferred aspect this invention provides a method of screen printing utilizing a screen printing machine comprising a rotor and a stator wherein one of or part of one of the rotor and stator is movable vertically to bring the rotor and stator into juxtaposition and wherein the method comprises rotating and guiding the rotor with a measure of accuracy and during the vertical movement guiding the rotor and stator or said part with a greater measure of accuracy as they approach juxtaposition. Thus, approximate guidance may be had via the annular track and track follower means and final guidance may be had by means of the abutments.

The following concerns the lifting means and related aspects. The lifting means is preferably located at a radial position in the same plane or in a parallel plane being not less than 25% of the radius of the rotor from the radial center with not less than 30% being more preferred. Preferably the lifting means comprises a plurality of individual lifters arranged to lift substantially in unison. Preferably at least some of the lifters are linked via a torsion member, or comprise locking cylinders, set to lift substantially through the same distance.

Specific constructions of screen printing machines and parts thereof illustrating various aspects of this invention will now be described by way of non-limiting example with the aid of the accompanying drawings.

DESCRIPTION OF THE PREFERRED EMBODIMENTS

Figure 1:
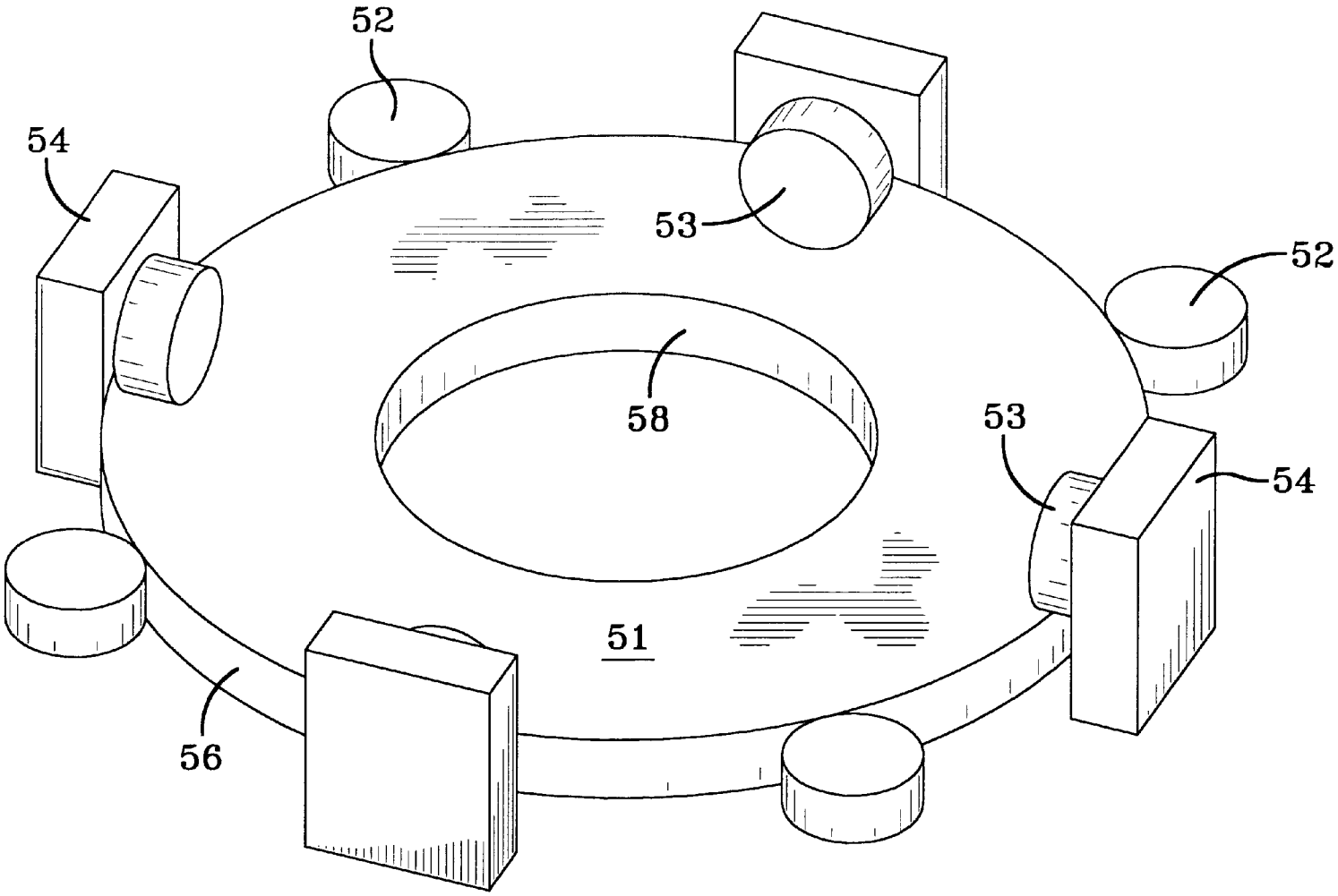
FIG. 1 is an isometric view of an annular track and track followers.

Reference is made to FIG. 1 which shows an annular track 51 having an outer 56 and an inner perimeter 58 , perimetric track followers 52, and annular surface followers 53 which are mounted to supports 54. The track 51 may be mounted to a base and the followers 52 and 53 may be mounted to a rotor of a screen printing machine. Alternatively, the followers 52 and 53 may be mounted to a base and the track 51 may be mounted to a rotor of a screen printing machine.

Figure 4:
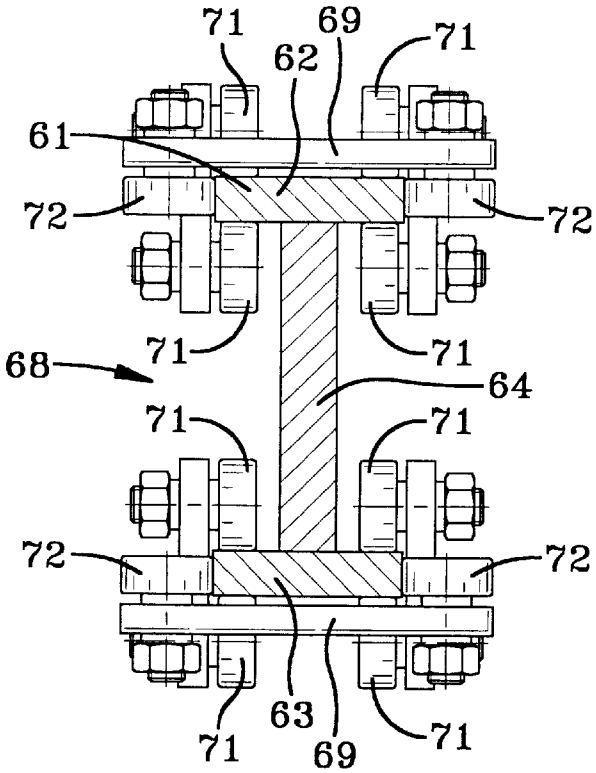
FIG. 4 is a cross-sectional view of the track of FIG. 2.
Figure 3:
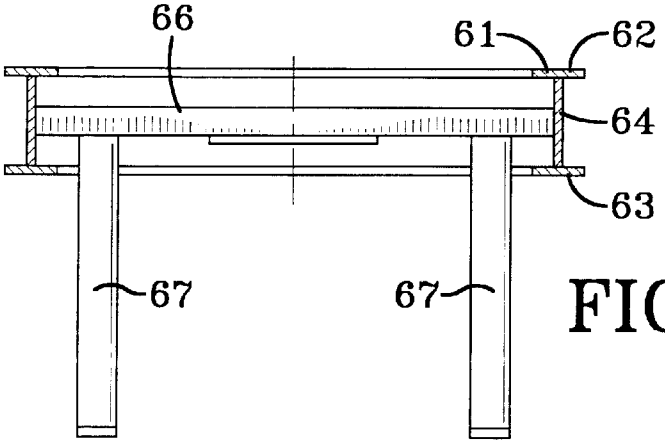
FIG. 3 is a cross-sectional view of the track of FIG. 2.
Figure 2:
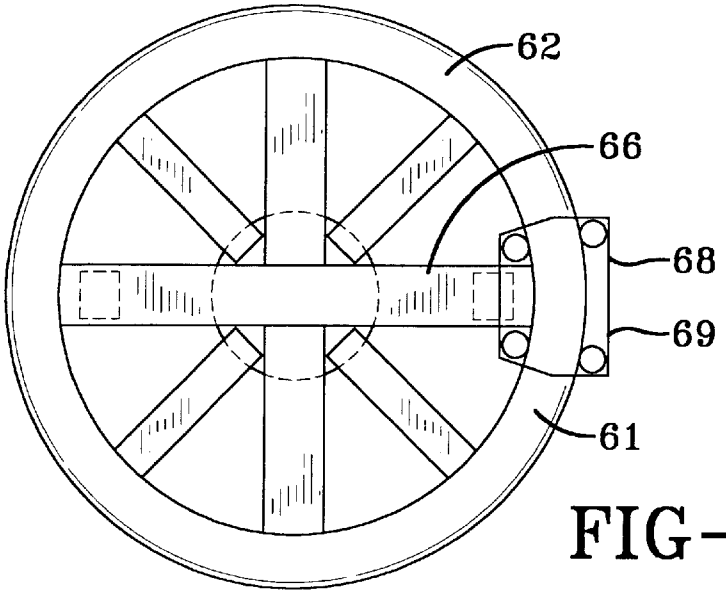
FIG. 2 is a top plan view of an annular track and track followers.

Reference is made to FIGS. 2–4 which show an annular track 61 which is I-shaped in cross section and which comprises an upper annulus 62, a lower annulus 63 and a cylindrical web 64 which spaces the annuli 62 and 63 apart. Radial beams 66 extend across the web 64 and legs 67 depend from those beams. In use, several carriages such as carriage 68 are carried by the track 61. Each of the carriages 68 comprises a frame 69 to which rollers 71 are mounted for rotation about horizontal axes and for engagement with the upper and lower surfaces of the annuli 62 and 63. Rollers 72 are also mounted to the frames 69 for rotation about vertical axes and for engagement with the inner and outer surfaces of the annuli 62 and 63.

In use, a rotor of a screen printing machine will be attached to the frames 69. The dimensions shown in FIGS. 2 and 3 are not limiting but it can easily be realized that the support area and location for the rotor will be far superior to that provided by the column 42 and bearings 45 and 49 shown in FIG. 1D.

Figure 1A:
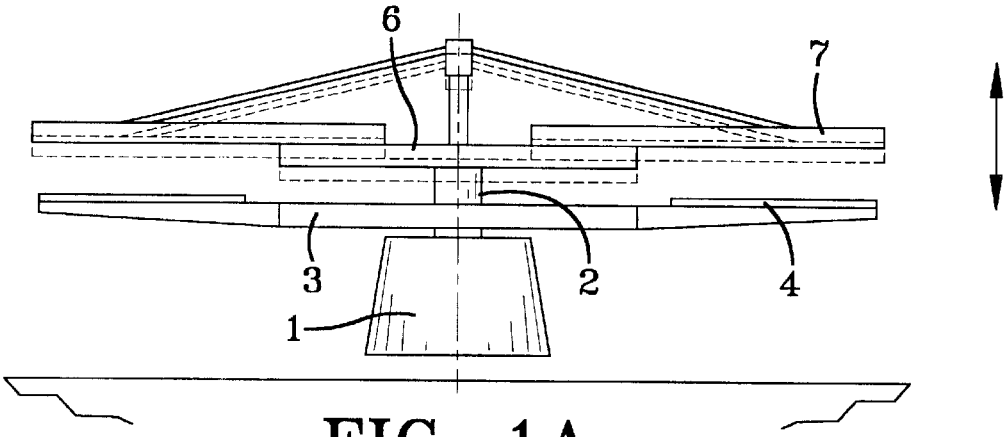
FIG-1A PRIOR ART
FIG. 1A is a side elevational view of a lifting stator machine.
Figure 1B:
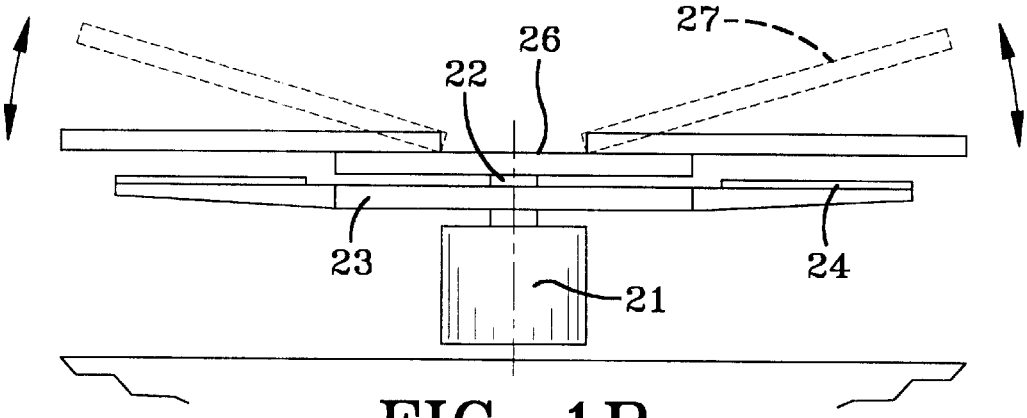
FIG-1B PRIOR ART
FIG. 1B is a side elevational view of a pivoting arm machine.
Figure 1C:
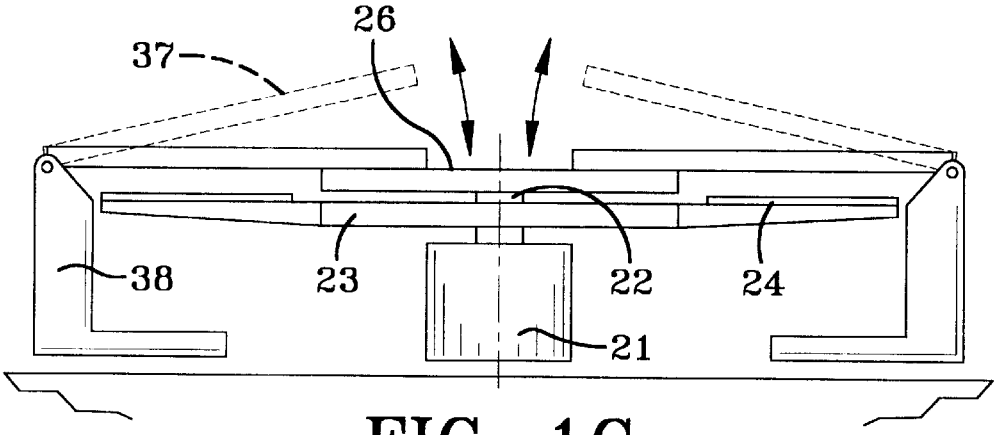
FIG-1C PRIOR ART
FIG. 1C is a side elevational view of a pivoting arm (clamp shell) machine.
Figure 5:
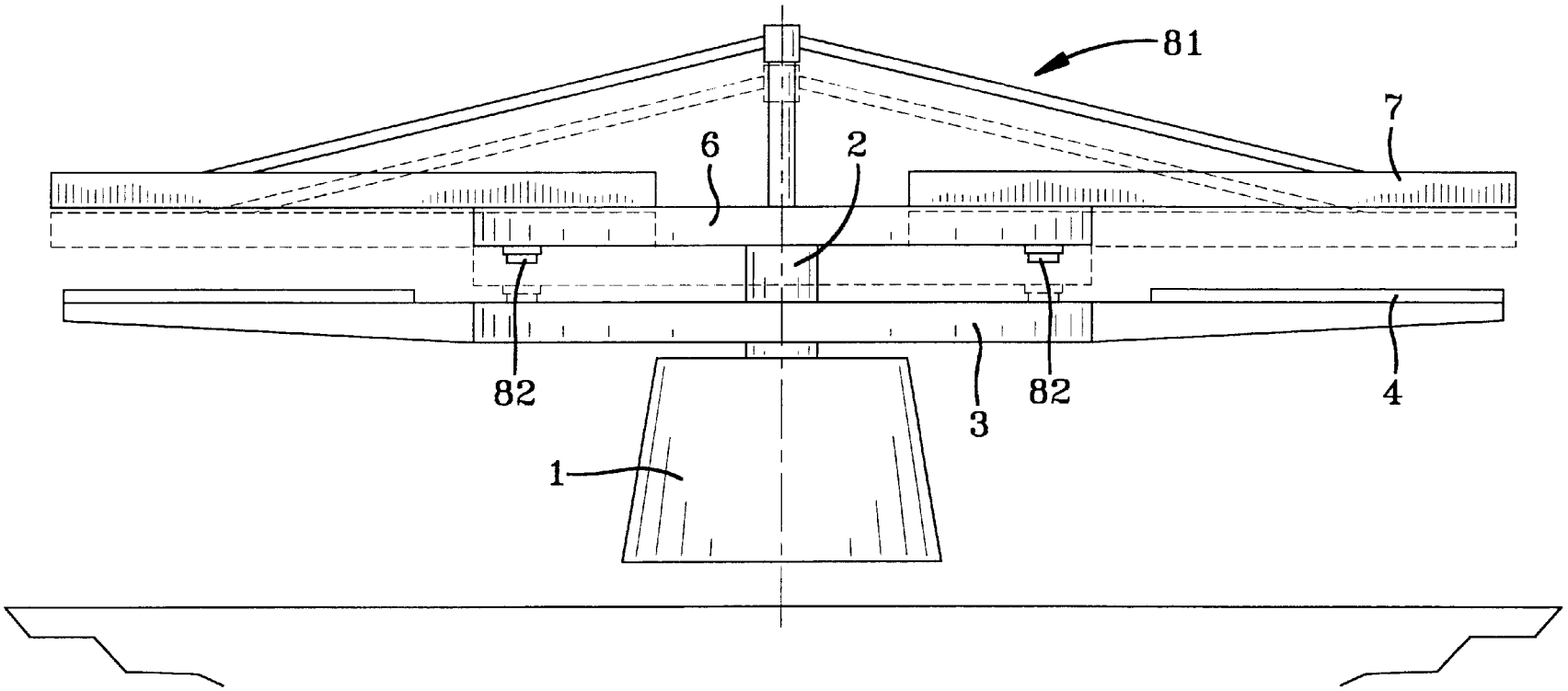
FIG. 5 is a side elevational view of a first screen printing apparatus.

Reference is now made to FIG. 5 which shows the first screen printing machine 81 which is similar to the machine shown in FIG. 1A and like reference numerals denote like parts. However abutments 82 have been included which are adjustable in position radially, angularly and vertically and will assist in stabilizing the stator 6 with respect to the rotor 3, the angular register of the stator 6 with the rotor 3 and also the vertical spacing of the stator 6 with respect to the rotor 3.

Figure 1D:
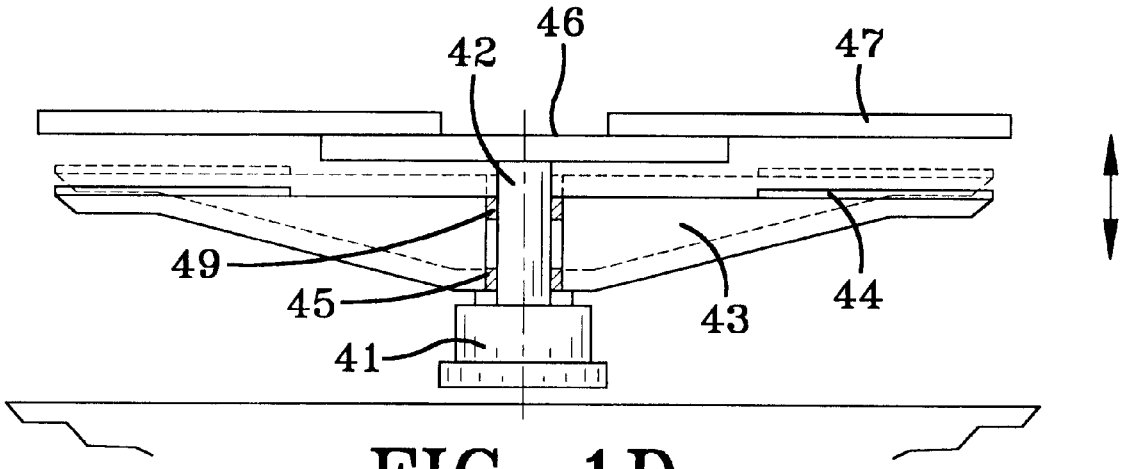
FIG-1D PRIOR ART
FIG. 1D is a side elevational view of a lifting pallet machine.
Figure 1E:
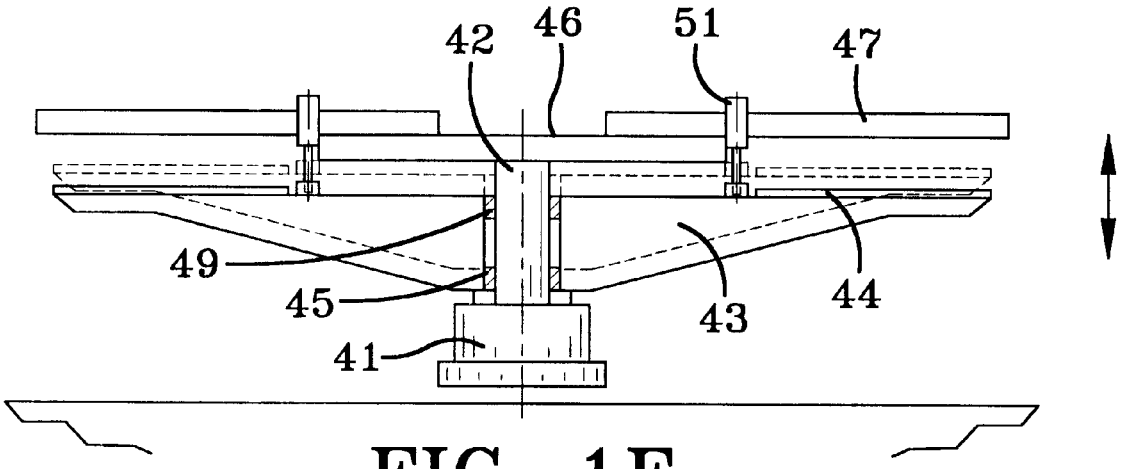
FIG-1E PRIOR ART
FIG. 1E is a side elevational view of a lifting pallet machine with a lift assist cylinder.
Figure 6:
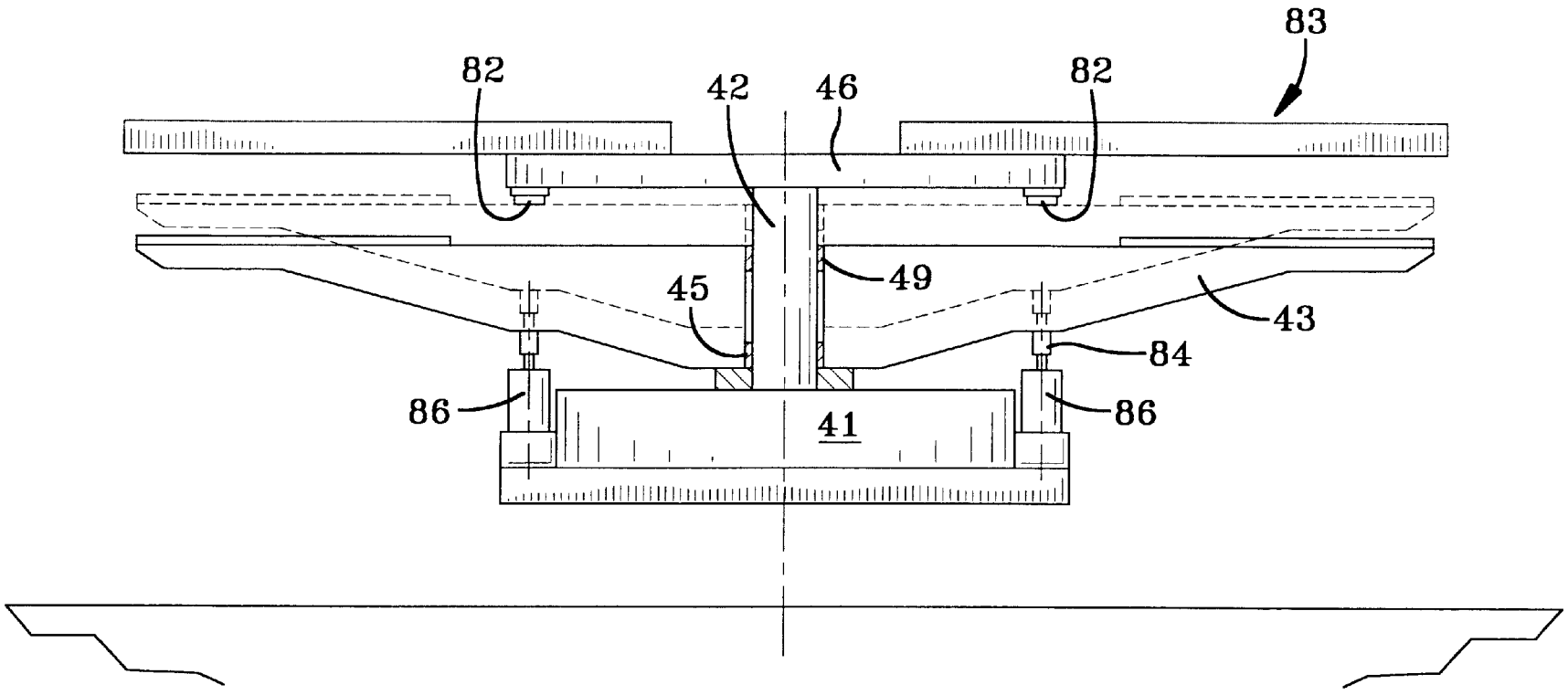
FIG. 6 is a side elevational view of a second screen printing apparatus.

Reference is now made to FIG. 6 which shows the second screen printing machine 83 which is similar to the machine shown in FIG. 1D and like reference numerals denote like parts. However, abutments 82 are also provided as in respect of FIG. 5 and the abutments 82 can be locatably engaged with the rotor 43. Abutment 82 enters recess 84 as the rotor and stator approach juxtaposition, to increase their relative positions at juxtaposition. The engagement is shown with the rotor represented by the dotted lines. Further lifting elements 86 are provided at a substantial radial distance from the column 42.

Figure 7:
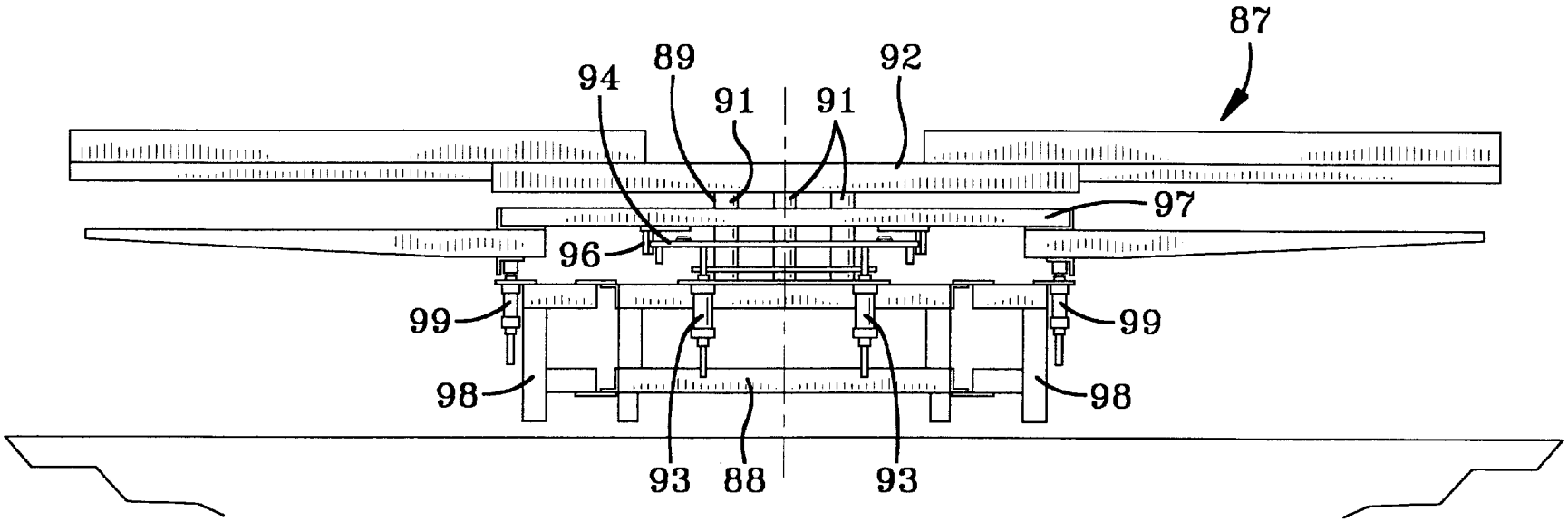
FIG. 7 is a side elevational view of a third screen printing apparatus.

Reference is now made to FIG. 7 which shows the third screen printing machine 87 which comprises a base 88, a central structure 89 comprised of a plurality of posts 91 and which support a stator 92. The structure 89 should be compared to the column 42 in FIG. 1D and it will be appreciated that it is a more stable and stronger unit than column 42. Lifting cylinders 93 are carried by the base 88 and support and can lift an annular track 94. Carriages 96 having track followers (not shown in detail but suitably similar to those shown in FIG. 1) can move on the track 94 and the carriages 96 support a rotor 97. To further stabilize the rotor 97, extensions 98 to the base 88 are provided and carry lifting cylinders 99 which can assist in lifting the rotor 97 and by being at a substantial radial distance from the center of rotation of the rotor will reduce the cantilever effect that the rotor produces.

Figure 8:
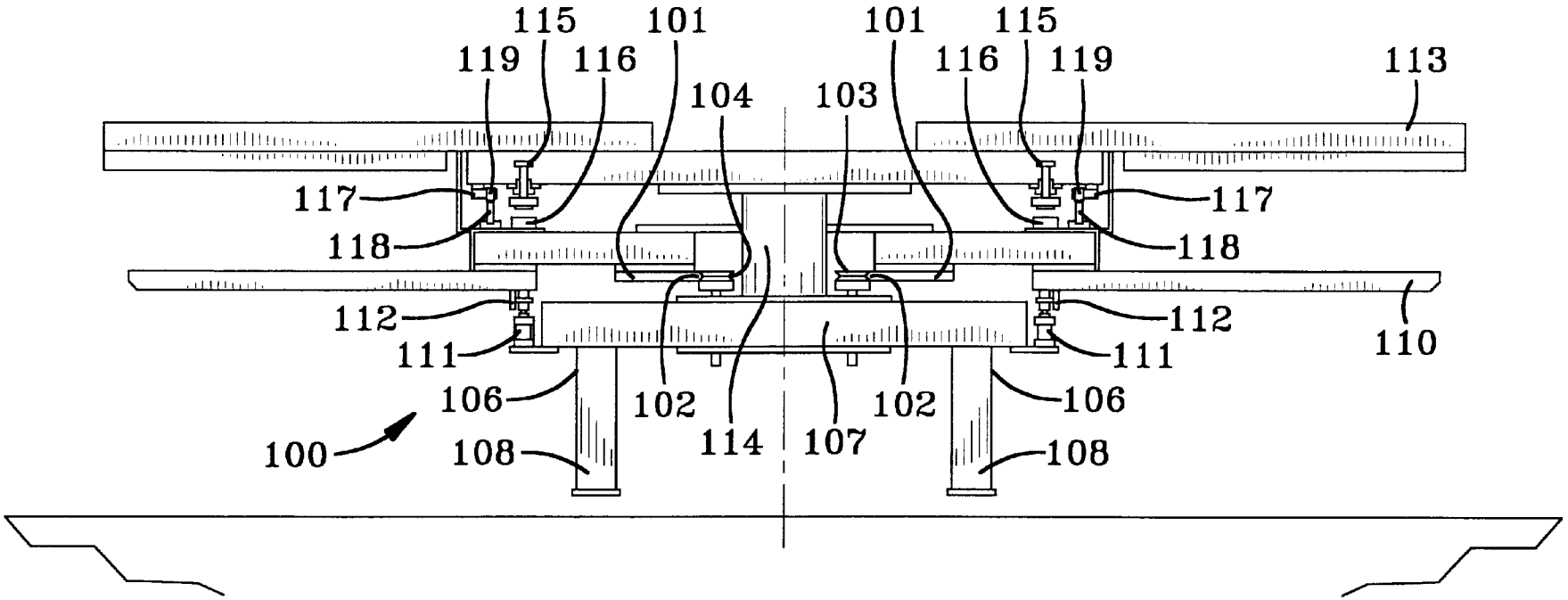
FIG. 8 is a side elevational view of a fourth screen printing apparatus.

Reference is now made to FIG. 8 which shows the fourth screen printing machine 100. This machine includes an annular track 101 provided with a central opening defined by an internal circular track profile 102, 104 which has a generally inverted V-shaped configuration. A plurality of followers 103 are provided with complementary V-shaped profiles. The followers are mounted via bearings and shafts on a pedestal 106 having a top 107 and a number of supporting posts 108.

The rotor 110 is mounted on the annular track 101 and a plurality of lifting elements 111 which may comprise hydraulic cylinders, are provided for lifting the rotor into juxtaposition with the stator 113 held by column 114. The hydraulic cylinders are preferably locking cylinders which are each set to lift the same distance in order to ensure an even lift of the rotor 110. In their retracted position as shown, the lifting elements 111 are just clear of the rotor 110 in order to allow free rotation between indexing. An annular crash ring 112 may be provided to limit the upward travel of the lifting elements should the angular registry of the rotor and stator be incorrect.

A plurality of different types of abutments 115, 116, 117 and 118 (see also FIGS. 9 and 10) are provided to locate the relative positions of the rotor and stator angularly and vertically when the two are brought into juxtaposition during indexation. The abutments 115 may have a height adjustable face 120 which is adjustable by turning a screw threaded member (not shown). The screw threaded member is provided within a turret 121 provided with complementary internal screw threads and can be turned by rotation of the collar 122.

A handle (not shown) may be provided in place of the collar. Alternatively the collar may be provided with sprocket, tooth pulley or similar means whereby it may be rotated by the action of a belt or chain 123. Thus a number of abutments 115 may be adjusted simultaneously by the action of the belt or chain when connected in the manner shown in FIG. 9. Tensioning means 124 which may comprise a spring loaded idler pulley or sprocket etc. may also be provided. The abutments opposite abutments 115 shown by reference numerals 116 may simply comprise blocks with a flat upper surface upon which abutments 115 may impinge.

Abutments 117 and 118 may be constructed to ensure accurate angular registry between the rotor and stator. Thus abutment 117 may be provided with a vertically directed slot (not shown) into which the end of abutment 118 may travel when the rotor and stator are brought into juxtaposition. A ball bearing 119 may be fitted on the end of abutment 117 to facilitate travel of the end along the slot.

Figure 9:
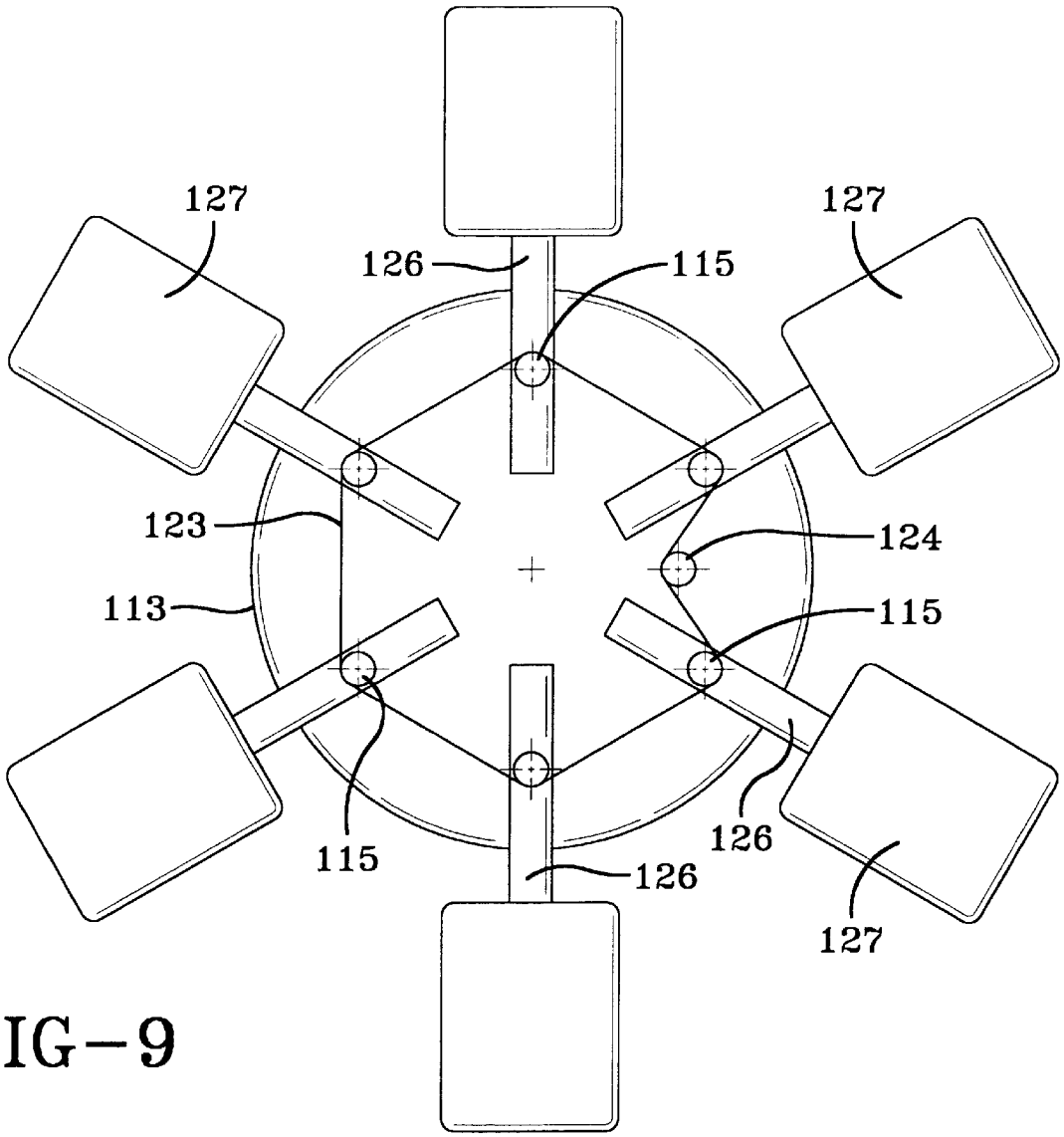
FIG. 9 is a plan view of the stator of the fourth screen printing apparatus.
Figure 10:
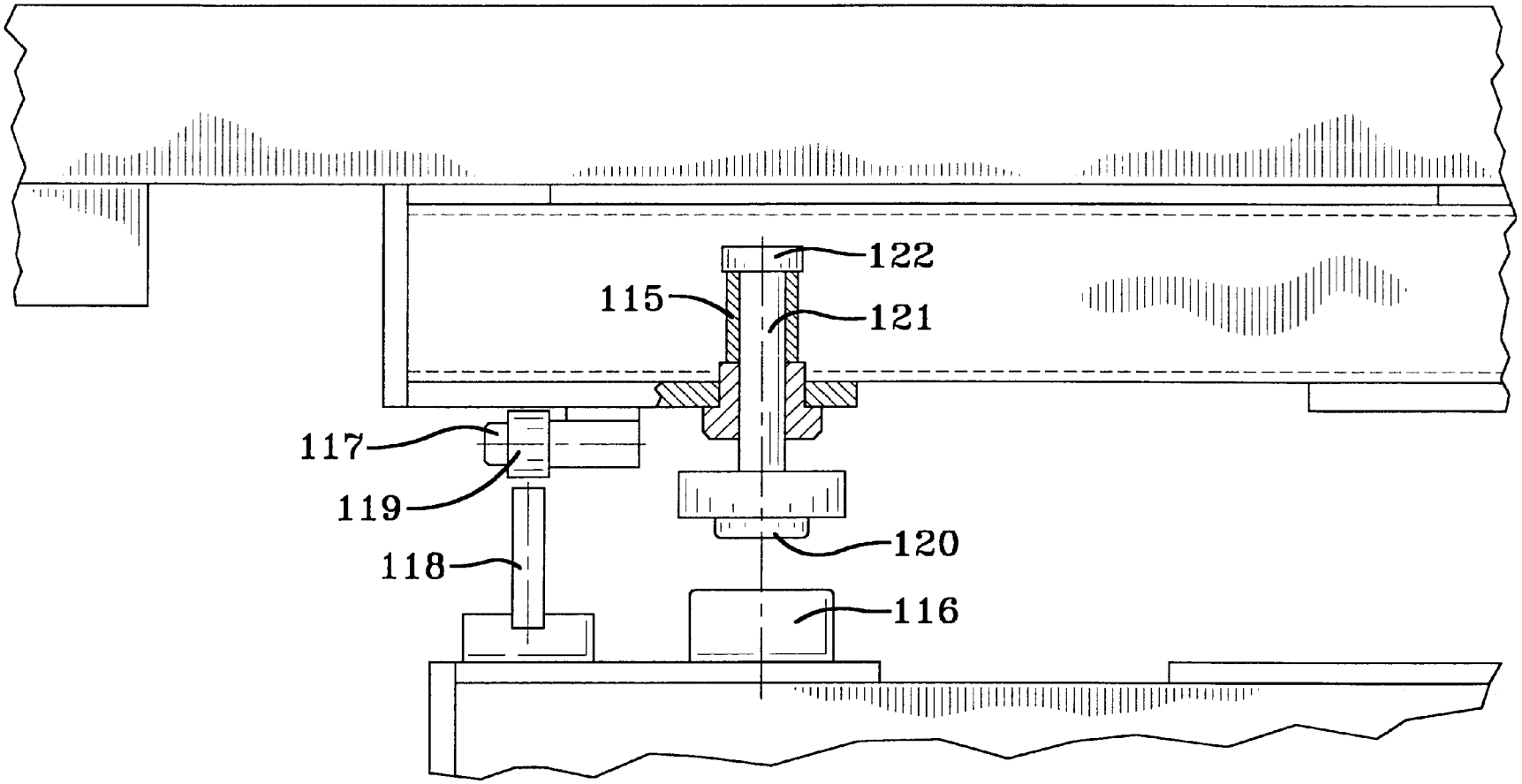
FIG. 10 is an enlarged elevational view of the abutments shown in FIG. 9.

FIG. 9 also shows a stator arrangement for use in the screen printing machine of FIG. 8 although it is noted that such an arrangement can be typical of the stator of the other screen printing machines described in the earlier drawings. The stator includes a plurality of arms 126 which support screen printing stations 127, adapted to index with work stations provided on the rotor (not shown) when the two are brought into juxtaposition.

Finally it is to be understood that various alterations, modifications and/or additions may be incorporated into the various constructions and arrangements or parts without departing from the spirit and ambit of the invention.

I claim:

1. A screen printing machine comprising a rotor, a stator, movement means operatively connected to said rotor and said stator, and annular track means and track follower means operatively associated with the rotor, wherein one of or a part of one of the rotor or stator is movable by the movement means vertically to bring the rotor and stator into juxtaposition, and the annular track means and the track follower means guide the rotor to turn in a plane of, or a plane parallel to, that of the annular track means, and wherein the track means and track follower means provide substantial guidance of the rotor in so turning in both vertical and radial directions, wherein the annular track means comprises an internal annulus with an inner and an outer perimeter, and wherein the annular track means is provided with a profiled surface around its inner or outer perimeter, with the follower means being correspondingly profiled to guide the rotor to turn in the plane of, or a plane parallel to that of the annular track means.

2. A screen printing machine according to claim 1, wherein the profiled surface has a generally inverted V-shape and the follower means have a complementary V profile.

3. A screen printing machine according to claim 1, wherein the follower means have a generally inverted V-shape and the profiled surface has a complementary V profile.

4. A screen printing machine comprising a rotor, a stator, movement means operatively connected to one of the rotor and the stator, and annular track means and track follower means for cooperatively guiding movement of the rotor wherein one of or part of one of the rotor and stator is movable by the movement means vertically to bring the rotor and stator into juxtaposition, the rotor and stator including radially disposed abutments adapted to come into abutting relation on such vertical movement to provide support for an upper one of the rotor and stator, wherein the annular track means comprises a perimeter, an internal circular opening defining a track annulus, and a profiled surface around one of the perimeter and the internal circular opening; and wherein said track follower means are operatively associated with the rotor, and are correspondingly profiled with the profiled surface, the profiled surface cooperating with the correspondingly profiled track follower means to guide the rotor to turn in a plane of, or a plane parallel to that of the annular track means.

5. A screen printing machine according to claim 4, wherein the profiled surface has a generally inverted V-shape and the track follower means have a complementary V profile.

6. A screen printing machine comprising a rotor, a stator, movement means operatively connected to one of the rotor and the stator, and annular track means and track follower means for cooperatively guiding movement of the rotor wherein one of or part of one of the rotor and stator is movable by the movement means vertically to bring the rotor and stator into juxtaposition the rotor and stator including radially disposed abutments adapted to come into abutting relation on such vertical movement to provide support for an upper one of the rotor and stator, and further comprising adjustment means for adjusting by rotation at least some of the abutments, and linking means for interconnecting the adjustment means to synchronize rotation of the adjustment means.

7. A screen printing machine comprising a rotor, a stator, support means for supporting and guiding the rotor in rotation, lifting means operatively associated with the rotor and the stator, and annular track means and track follower means for cooperatively guiding movement of the rotor, wherein one of or part of one of the rotor and the stator is movable vertically to bring the rotor and the stator into juxtaposition and wherein the support means supports the guiding of the rotor in rotation, and the lifting means vertically moves said one of or part of one of the rotor and stator and the lifting means being located radially outward of said support means, wherein the annular track means comprises an internal annulus with an inner and outer perimeter, and wherein the annular track means is provided with a profiled surface around its inner or outer perimeter with the track follower means being correspondingly profiled to guide the rotor to turn in the plane of, or a plane parallel to that of the annular track means.

8. A screen printing machine according to claim 7, wherein the profiled surface has a generally inverted V-shape and the follower means have a complementary V profile.

9. A screen printing machine according to claim 7, wherein the follower means have a generally inverted V-shape and the profiled surface has a complementary V profile.

10. A screen printing machine comprising a rotor, a stator, support means for supporting the rotor, lifting means operatively associated with the rotor and the stator, annular track means and track follower means for cooperatively guiding movement of the rotor, wherein one of or part of one of the rotor and the stator is movable vertically to bring the rotor and the stator into juxtaposition and wherein the support means supports the guiding of the rotor in rotation, and the lifting means vertically moves said one of or part of one of the rotor and stator located radially outward of said support means, and a plurality of abutments on the rotor and/or stator to position the rotor and stator vertically, laterally, radially or angularly with respect to one another, and wherein at least some of the abutments are adjustable by rotation of adjustment members and the adjustment members are interconnected by means which synchronize rotation of the adjustable members.

11. A screen printing machine comprising a rotor and a stator, wherein one of or part of one of the rotor and the stator is movable vertically to bring the rotor and the stator into juxtaposition, and wherein the machine further comprises guiding means for guiding the rotor in rotation, support means for supporting the guiding means, lifting means located radially outward of said support means for vertically moving said one of or part of one of the rotor and stator, and a plurality of abutments, and adjustment means for adjusting by rotation the abutments, the adjustment means being interconnected by linking means for synchronizing rotation of the adjustable means.

* * * * *